US007040451B2

(12) United States Patent
Schumacher et al.

(10) Patent No.: US 7,040,451 B2
(45) Date of Patent: May 9, 2006

(54) AUTOMOTIVE EXHAUST SILENCER SYSTEM WITH VARIABLE DAMPING CHARACTERISTICS

(75) Inventors: Herbert Schumacher, Lichtenwald (DE); Volker Geis, Waiblingen (DE)

(73) Assignee: J. Eberspächer GmbH & Co., Esslingen (DE)

( * ) Notice: Subject to any disclaimer, the term of this patent is extended or adjusted under 35 U.S.C. 154(b) by 81 days.

(21) Appl. No.: 10/018,979

(22) PCT Filed: Apr. 26, 2001

(86) PCT No.: PCT/EP01/04694

§ 371 (c)(1),
(2), (4) Date: Dec. 18, 2001

(87) PCT Pub. No.: WO01/81734

PCT Pub. Date: Nov. 1, 2001

(65) Prior Publication Data

US 2002/0175022 A1 Nov. 28, 2002

(30) Foreign Application Priority Data

Apr. 26, 2000 (DE) ..... 100 20 491

(51) Int. Cl.
*F01N 1/00* (2006.01)

(52) U.S. Cl. ..... 181/254; 181/257; 181/268; 181/272; 181/253; 181/239; 123/184.53

(58) Field of Classification Search ..... 181/254, 181/212, 227, 238, 239, 251, 253; 251/84; 137/527; 123/184.53
See application file for complete search history.

(56) References Cited

U.S. PATENT DOCUMENTS

| | | | | |
|---|---|---|---|---|
| 2,072,372 | A * | 3/1937 | Kingsley | 181/264 |
| 4,866,933 | A * | 9/1989 | Kao | 181/254 |
| 4,913,260 | A * | 4/1990 | Fallon | 181/254 |
| 4,926,636 | A * | 5/1990 | Tadokoro et al. | 60/312 |
| 5,821,474 | A * | 10/1998 | Olszok et al. | 181/254 |
| 6,178,745 | B1 * | 1/2001 | Meusen | 60/312 |

FOREIGN PATENT DOCUMENTS

| | | |
|---|---|---|
| DE | 195 03 322 A1 | 2/1995 |
| DE | 198 37 097 A1 | 8/1998 |
| WO | PCT/NL97/00204 | 4/1997 |

* cited by examiner

*Primary Examiner*—Marlon T. Fletcher
*Assistant Examiner*—Renata McCloud

(57) ABSTRACT

In a muffler device of a motor vehicle, with a plurality of mufflers and an actuator for changing the flow resistance to the exhaust gases flowing through the mufflers, in order to change the damping characteristic, the actuator is provided in a pipe branch having an inlet and two outlets, each outlet being connected via a pipe to a muffler, and the throughflow cross section of the inlet being variable by means of the actuator.

3 Claims, 4 Drawing Sheets

AUTOMOTIVE EXHAUST SILENCER SYSTEM WITH VARIABLE DAMPING CHARACTERISTICS

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a muffler device of a motor vehicle, with a muffler and with an actuator for changing the flow resistance of the exhaust gas flowing through in order to vary the damping characteristic.

TECHNICAL FIELD

From DE 195 03 322 A1, a muffler device with variable damping characteristic of the said kind is known, in which a muffler has a disk valve in the inlet pipe in order to change the amount of exhaust gas flowing through, the free end of the valve plunger of the disk valve being connected to a pressure container. The pressure side of the pressure container is connected via a pressure duct to the inlet side of the inlet pipe. Due to the pressure control, the valve disk of the disk valve continuously opens and closes, so that the acoustic properties of the muffler continuously change. The disk valve is arranged in the interior of the muffler. The disk valve, and also the actuating mechanism of the disk valve, particularly the valve plunger, extend in the interior of the muffler, in particular at least partially in a resonance chamber in the interior of the muffler. The disk valve arrangement is an internal component of the muffler itself. The internal flow obstacle of the disk valve arrangement impairs the damping characteristic of the muffler, particularly for high power internal combustion engines. For high power internal combustion engines, two separate mufflers are necessary, each with a said pressure control.

SUMMARY OF THE INVENTION

The invention has as its object to provide a muffler device of the said kind, which with simple means effects an optimum damping even for high power internal combustion engines, particularly in the low frequency range, and at the same time is of compact construction.

This object is attained by a muffler device of a motor vehicle comprising a plurality of mufflers, and an actuator for changing a flow resistance of exhaust gases flowing through the mufflers to change the damping characteristic of the muffler device, wherein the actuator is provided in a pipe branch comprising an inlet and a plurality of outlets, each outlet being connected by a pipe connecting to one of the mufflers, and a throughflow cross section of the inlet being variable by means of the actuator.

The essence of the invention is that the actuator is arranged in a flow branch with an inlet and two outlets, each outlet being connected to a muffler by a pipe, the flow cross section of the inlet being variable by means of the actuator.

A particular advantage of the invention is that the interior of the muffler—arrangement of the internal exhaust gas conduction through the muffler, pipe bends, pipe lengths, resonance chamber(s), absorption chamber(s), sound absorbing material, partitions, intermediate shells, perforation configuration, etc.—is designed without an interfering actuator or disk valve, and thus the internal damping characteristic of the muffler can be optimally designed. The limitation or control of counter-pressure takes place outside the muffler proper in an arrangement positioned in advance of it. According to the invention, two individual mufflers are provided, which have a common counter-pressure limitation or control. According to the abovementioned state of the art, two separate related devices are necessary. The invention thus practically reduces the cost to half.

A further special advantage of the invention is that the distribution of the volume flows in the two outlets of the pipe branch cannot be influenced. Also, in a constructional design of the whole device of a muffler arrangement, the device of a middle muffler can be omitted.

Advantages in construction and manufacture result when the two mufflers are preferably of like construction. The pipe ducts appropriately have the same throughflow cross section, in order to give each of the mufflers the same flow properties and the same damping characteristic.

The outlets of the pipe branch are in particular made symmetrical with respect to the axial axis of the inlet of the pipe branch, with the actuator extending along, and symmetrically of, the axial axis of the inlet.

The actuator can be constructionally united, at least in large part, with the pipe branch and consequently integrated into the pipe branch.

The actuator is advantageously prestressed by means of a spring, preferably a compression spring, toward its closed position which largely closes the inlet, and is movable against the force of the spring into an opening position which opens the inlet when there is an increase of the counter-pressure of the flowing exhaust gas before the inlet.

The actuator appropriately has a closure member which can be brought into engagement with the inlet and which has on the periphery at least one indentation, preferably two indentations equally distributed on the periphery, and also axial passages can be provided which are preferably equally distributed over the cross section of the closure member. Exhaust gas can thereby flow through the closure member, even when the actuator is closed at a low load or at a low rpm of the motor vehicle engine. If the load or the engine rpm increases, a greater flow resistance or counter-pressure builds up at the actuator and then is decreased by opening the actuator, or reaches an upper limit.

Another variant provides that the actuator has a closure body which can be brought into engagement with the inlet and has a diameter such that a peripheral gap toward the internal diameter of the inlet remains free in the closed position. The peripheral gap has the same effect as the said indentations or axial passages.

The actuator is preferably a control valve with a valve plunger, the closure member can then be a flattened, conical, or hemispherical valve disk or valve member.

The closure member, including indentations, etc., is advantageously of streamlined construction, in order to already reduce in this manner throughflow noises at the closure member.

The actuator, in a basic variant embodiment, is a passive control element which automatically moves into its opening position due to the force of the counter-pressure.

The force of the counter-pressure before the inlet of the pipe branch can thus act directly on the cross sectional surface of the closure member exposed to the exhaust gas flow, in order to automatically open the actuator against the spring force.

Another variant of a passive control element provides that the force of the counter-pressure is exerted on a separate actuating element of the actuator which in its turn then moves the actuator into its opening position. In this case, the actuating element is preferably a pressure container, the pressure side of a diaphragm in the pressure container being connected via a pressure duct to the counter-pressure before the inlet of the pipe branch, while the spring in the pressure container is arranged on the low pressure side of the diaphragm, and the middle of the diaphragm is connected to the actuator, particularly to the free end of the valve plunger of a disk valve.

A particularly advantageous development of the invention is given when the actuator, in a further basic variant embodiment, is an active control element and has a separate actuating element which is controllable by the control electronics of the motor vehicle engine or by the motor management. In this case, the actuating element is preferably a low pressure container, the low pressure side of a diaphragm in the low pressure container being connected via a control duct to a vacuum pump or to the intake pipe of the motor vehicle engine, and the middle of the diaphragm being connected to the actuator, in particular to the free end of the valve plunger of a disk valve.

The pressure side of the diaphragm of the low pressure container has a housing vent bore and is thus exposed to atmospheric pressure or, without a housing portion, directly to the atmosphere.

The spring is appropriately arranged on the low pressure side of the diaphragm in the low pressure container, so that a compact overall arrangement of an actuating element results.

At least one electromagnetically operable on/off valve or a continuously adjustable pressure regulating valve can be arranged in the said control duct, and is then respectively driven by the control electronics of the motor vehicle engine via an electrical control lead.

The electromagnetically operable on/off valve can be a 3/2-way valve with three connections and two positions, known per se, the first connection leading to the suction pipe or to the vacuum pump, the second connection to the low pressure side of the low pressure container, and the third connection to the atmosphere. Then in the first valve position the first connection is connected to the second connection, and in the second valve position the second connection is connected to the third connection.

Thus, preferably with a low pressure container as the active actuating element, the low pressure can be derived from the intake pipe of the engine or can be produced by a vacuum pump. The magnetic changeover valve controlled by the engine management effects the supply to the diaphragm container of low pressure (-→valve "open") or of atmospheric pressure (venting-→valve "closed").

The actuator can have a valve plunger which is guided, sealed and displaceably, through a sealing plug in a partition of the pipe branch between the two outlets, outward along the axial axis of the inlet as far as a spring housing containing the spring, or is secured to the stiffened, flattened middle of the diaphragm on the pressure side of the pressure container or low pressure container.

Here the sealing plug is preferably sealingly received in a hollow-cylindrical housing section of the spring housing or of the pressure container or low pressure container, and the housing section is secured to the partition.

The principle of operation according to the invention substantially consists in that a resistance is to be opposed to the exhaust gas by means of a spring-loaded valve, which is preferably an integral component of a flow branch. This leads to a decrease of the pulsations, thus leading to an improvement of the acoustics (orifice noise and/or vehicle interior noise). Starting from a given rpm/load, the valve is opened, so that the (power-influencing) counter-pressure of the exhaust gas device does not exceed a given value at higher rpms/loads. Flow noises are thus likewise prevented or reduced. The changeover/control of the valve can basically take place in two ways:

The one, last-named, way is the changeover/control by means of an active control element, namely by means of the low pressure container according to the adjustment of the control electronics or of the engine management.

The other way is the changeover/control by means of a passive control element, with the use of the counter-pressure before the inlet of the pipe branch, namely indirectly by means of the said actuating element of the pressure container, or directly only by means of the spring, which is preferably a compression spring. At low throughputs, the valve is then kept closed by the spring. With increasing throughputs, the valve begins to open and then remains stationary when the spring force is as great as the flow force acting on the valve disk. With this design, opening is continuous, and is indeed automatic, that is, without superordinate control.

According to individual embodiment variants, one or more springs can be provided in a packet. Individual springs can also have a different spring characteristic (linear, progressive). If necessary, for a spring, the spring support in the axial direction of the spring can also be adjusted, in order to arrange a desired spring force or closing force at the actuator.

The flow branch with integrated throttle according to the invention thus has, summarizing, the following features:

- Matching of the exhaust gas counter-pressure in the region of the flow branch by means of variable flow resistance.
- Regulating the flow resistance by means of an axially arranged active control element.
- Actuation of the control element preferably by means of a low pressure container. Driving takes place by means of the engine management.
- Actuation of the spring-loaded control element by means of exhaust gas counter-pressure. Thereby, opening of the control element is continuous.
- The control element can be constituted as a valve disk with a spacing from the housing. Alternatively, the control element can be a valve disk closely abutting the housing, with one or more recesses. The shape of the valve disk can also be flattened, conical, hemispherical, etc.
- At a low exhaust gas pressure, low flow throughput in the region of the flow branch, and thereby acoustic improvement, especially in the low frequency range.
- As against solutions with valves integrated into mufflers, of the kind mentioned at the beginning, the distribution of the volume flows (left/right) is not affected.
- Possible omission of a middle muffler.

BRIEF DESCRIPTION OF THE DRAWINGS

The invention is described in detail hereinbelow using embodiments [examples] and with reference to the accompanying drawings.

DETAILED DESCRIPTION OF THE INVENTION

Figure 1:
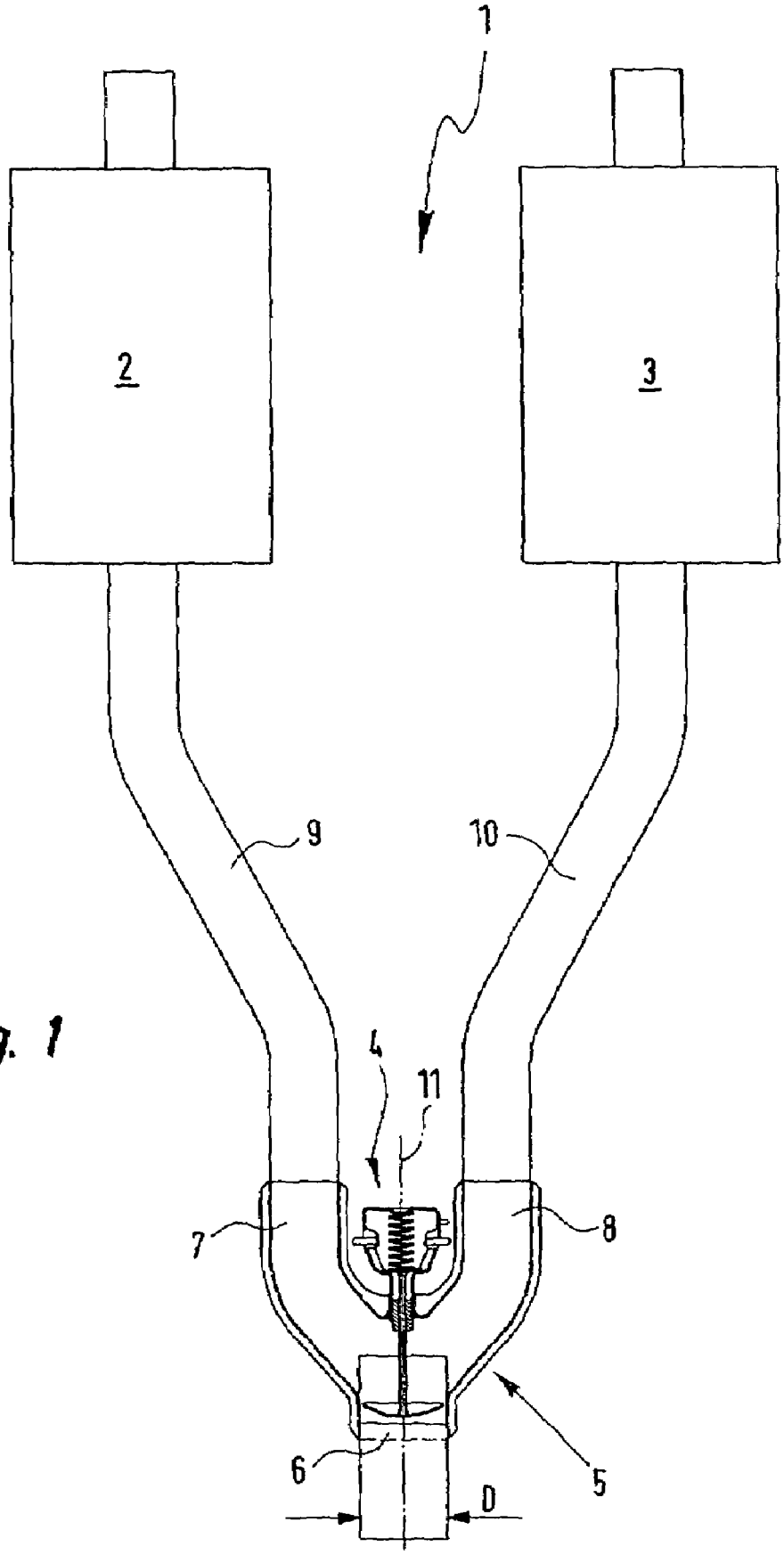
FIG. 1 shows a double muffler device of a motor vehicle, schematically in plan view, and partially in section in the region of a pipe branch.

According to the drawing, a muffler device 1 of a motor vehicle includes two mufflers 2, 3 and an actuator 4 for changing the flow resistances of the exhaust gases flowing through in order to change the damping characteristic.

The actuator 4 is provided in a flow branch 5 with an inlet 6 and two outlets 7, 8, each outlet 7 or 8 being connected by a pipe 9 or 10 to a muffler 2 or 3, and the flow cross section D of the inlet 6 being variable by means of the actuator. The two mufflers 2, 3 are of like construction. The pipes 9, 10 are equal in throughflow cross section. The outlets 7, 8 of the pipe branch 5 are symmetrical to the axial axis 11 of the inlet 6 of the pipe branch, with the actuator 4 extending along, and symmetrically of, the axial axis of the inlet. The actuator 4 is largely constructionally united to the pipe branch.

The device is constructed as a double muffler device of a single motor vehicle.

Figure 6:
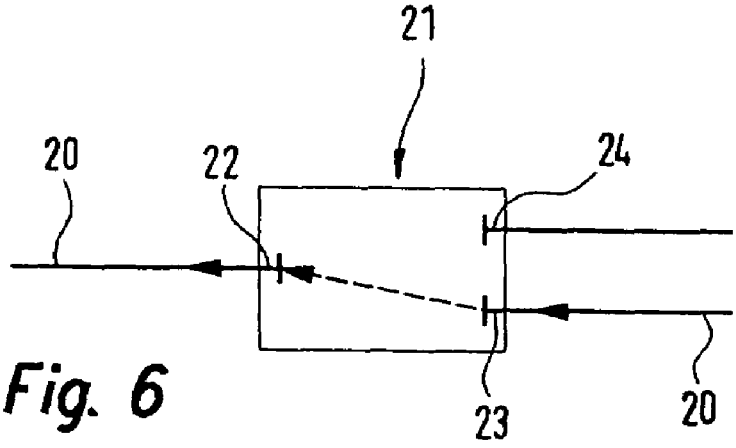
FIG. 6 shows an electromagnetically operated 3/2-way valve in one switching position.
Figure 7:
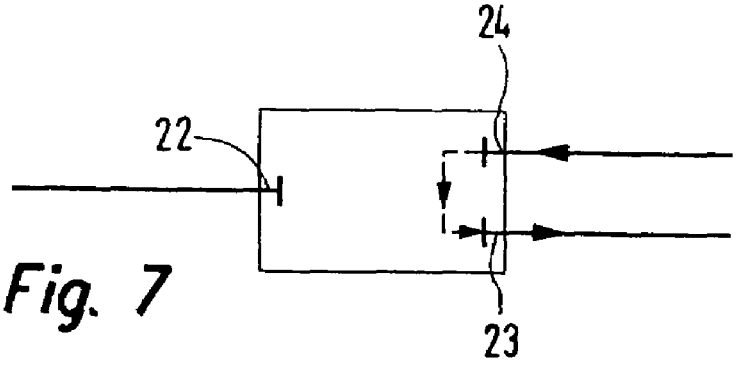
FIG. 7 shows the 3/2-way valve of FIG. 6 in the other switching position.

The motor vehicle engine (not shown) belonging to the vehicle is a high power drive. It has an intake pipe which is connected by means of a suction or control duct 20 to a separate actuating element 16 of the actuator 4. An electromagnetically operated 3/2-way valve is situated in the control duct 20, as shown in FIGS. 6 and 7. The 3/2-way valve has in its turn an electrical control lead which is connected to a control electronics (not shown) of the motor vehicle engine. The operation of the 3/2-way valve is described hereinafter.

In particular, the actuator 4 is prestressed by a spring 12 in the form of a compression spring in the direction of its closing position which largely closes the inlet 6, and is movable against the force of the compression spring into an open position releasing the inlet when there is an increased counter-pressure p of the flowing exhaust gas before the inlet 6.

Figure 3:
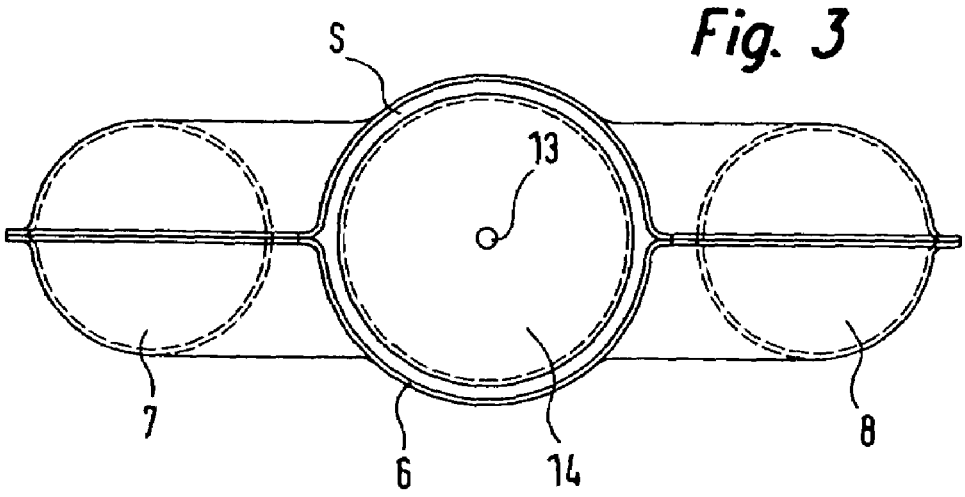
FIG. 3 shows the pipe branch of FIG. 2, in a schematic end view.
Figure 2:
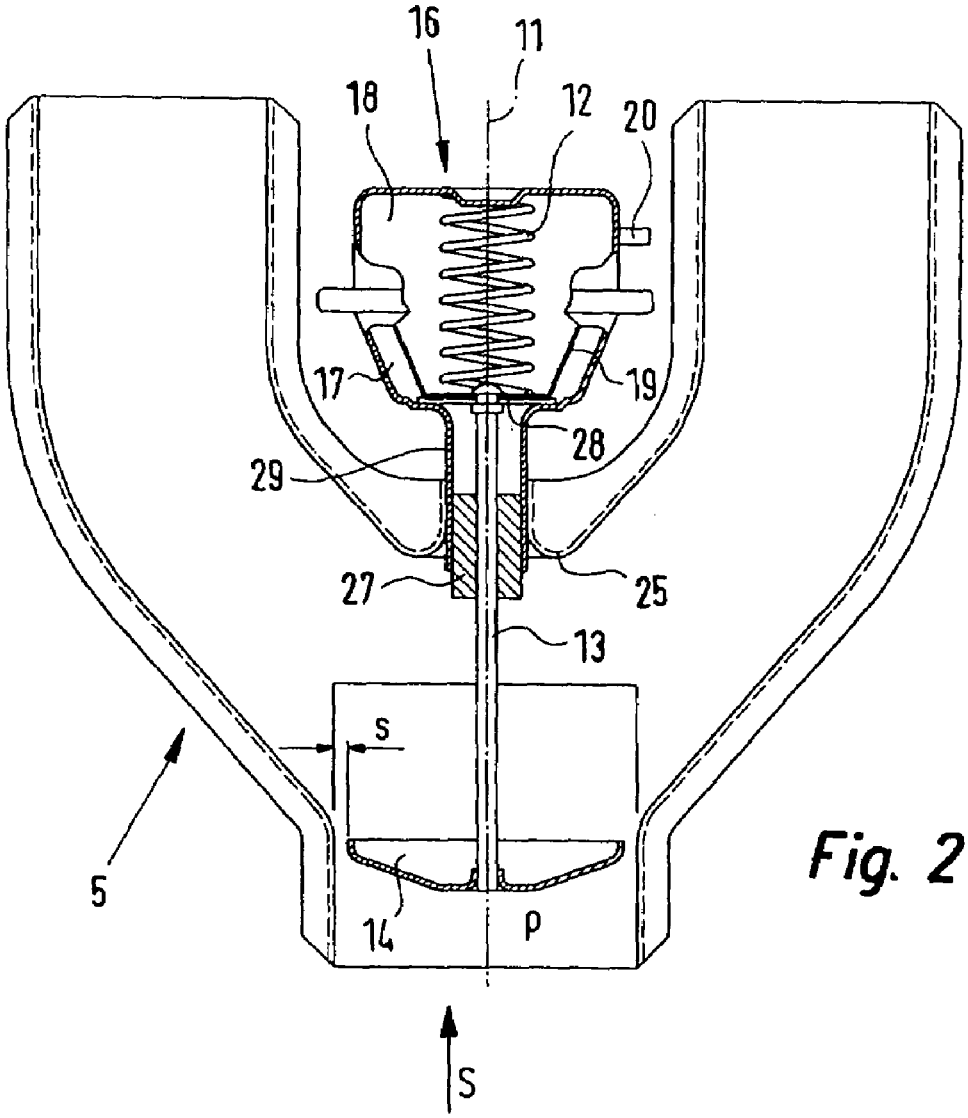
FIG. 2 shows the pipe branch of FIG. 1, in greater detail.

The actuator has a closure member which can be brought into engagement with the inlet and has a diameter such that in the closed position a peripheral gap s to the internal diameter of the inlet 6 remains free. This variant embodiment is shown in FIGS. 2 and 3. It shows that even in the closure position, closed per se, of the actuator, an annular throughflow space for the exhaust gas remains open in the region of the otherwise closed inlet 6 of the pipe branch 5 in any operating state of the muffler device 1.

Figure 5:
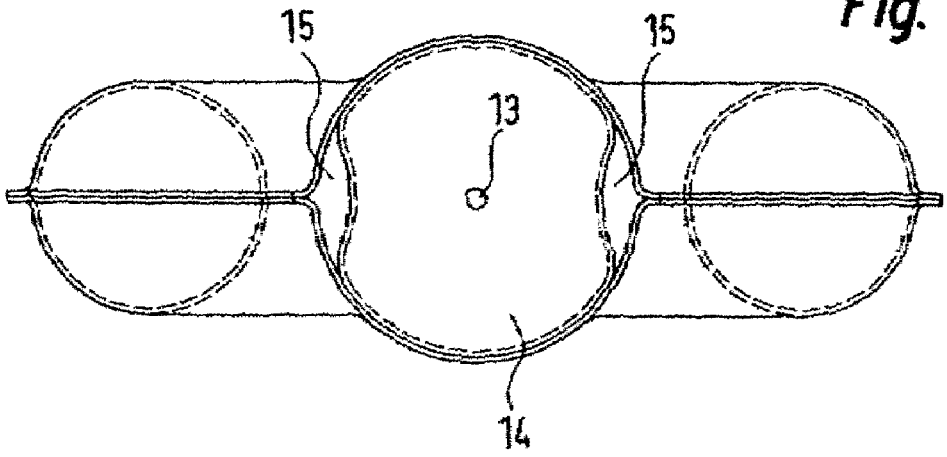
FIG. 5 shows the pipe branch of FIG. 4, in a schematic end view.
Figure 4:
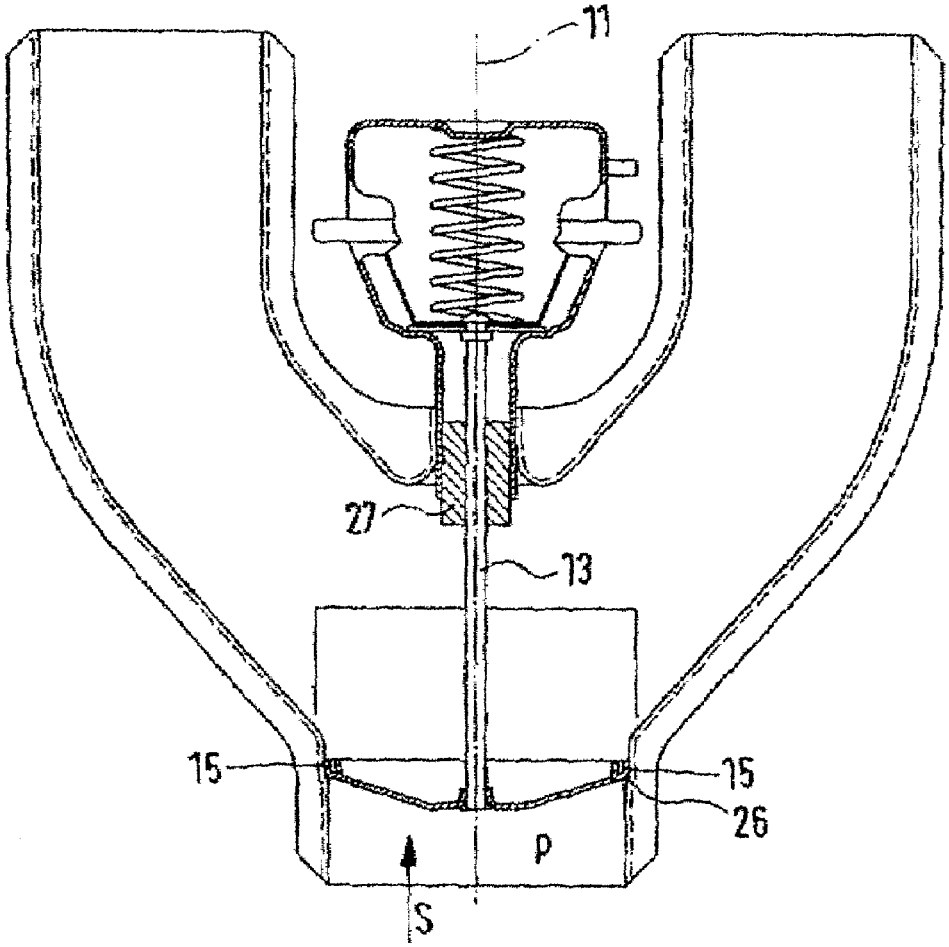
FIG. 4 shows another pipe branch similar to FIG. 2.

Instead of, or supplementary to, the peripheral gap s, the closure member 14 can have at least one indentation 15, preferably two indentations 15 uniformly distributed on the periphery, according to FIGS. 4 and 5. Except for the said indentations 15, a closure member can be supported in the closed position of the actuator on a peripheral edge of the inlet of the pipe branch, and can serve as a guide and in particular as an end stop of the closing position of the actuator. The peripheral edge, in the embodiment example of FIGS. 4 and 5, is a valve seat 26 in the form of a widened, stepped section in the housing wall in the region of the inlet of the pipe branch 5.

The actuator 4 is a control valve with a valve plunger 13, the closure member 14 being a flattened valve disk, which is slightly conical on its inflow side and is provided with rounded edges, favorable to flow, on its peripheral edge. The end positions of the control valve, i.e., the closed position and the open position, are established by the separate actuating element 16, further described hereinafter.

The actuator 4 can be a passive control element which automatically reaches its open position due to the force of the counter-pressure p. The force of the counter-pressure p then acts directly on the cross sectional surface of the closure member 14 of the actuator 4 exposed to the exhaust gas flow S, against the force of the compression spring 12.

In the case shown in FIGS. 2 and 3, however, the actuator 4 is an active control element, and the force of the counter-pressure p acts on the separate actuating element 16 of the actuator 4, which in its turn moves the actuator 4 into its open position.

The separate actuating element 16 is in particular a low pressure container, the low pressure side 18 of a diaphragm 19 in the low pressure container being connected via the control duct 20 to a vacuum pump or to the said intake pipe of the motor vehicle engine, and the stiffened, flattened circular diaphragm middle is connected to the free end of the valve plunger 13 of a disk valve which is remote from the closure member.

The pressure side 17 on the other side of the diaphragm 19 of the low pressure container has a housing vent bore and is thus exposed to atmospheric pressure, or is directly exposed to the atmosphere.

The compression spring 12 is arranged on the low pressure side 18 of the diaphragm 19 along the axial axis 11 in the low pressure container. It is supported, on the one hand, axially on the flattened diaphragm middle 28 and on the other hand on a central shaped seat in the low pressure container. The compression spring is centrally prestressed in the low pressure container. In the closed position of the disk valve of FIG. 2, a stepped axial stop of the housing of the low pressure container acts as a stop for the diaphragm middle 28. The housing has an integral, hollow-cylindrical housing section 29, which extends coaxially toward the closure body at a spacing from the valve plunger 13, and reaches as far as the interior of the pipe branch through a central perforation in a partition 25 of the pipe branch 5, and is secured to the partition.

The actuator 4 has, according to FIG. 2, a valve plunger 13 which is guided, sealingly and displaceably, through a sealing plug 27 in the said partition 25 of the pipe branch 5 between the two outlets 7, 8, along the axial axis 11 of the inlet 6, outward as far as the housing, containing the compression spring, of the low pressure container, the valve plunger 13 being secured to the stiffened, flattened diaphragm middle 28 of the diaphragm 19 on the pressure side of the low pressure container.

The sealing plug 27 is sealingly received in the hollow-cylindrical housing section 29 of the low pressure container.

The electromagnetically operable on/off valve 21 in the form of a 3/2-way valve according to FIGS. 6 and 7, arranged in the control duct 20, has a first connection 22 to the intake pipe of the motor vehicle engine, a second connection 23 to the low pressure side 18 of the low pressure container, and a third connection 24 to the atmosphere; in the one (first) valve position, the first connection 22 is connected to the second connection 23, and in the other (second) valve position, the second connection 23 is connected to the third connection 24. The first valve position is shown in FIG. 6. The second valve position is shown in FIG. 7.

Thus with the said low pressure container as the active actuating element, the low pressure can obviously be derived from the intake pipe of the engine. The magnetic reversing valve driven by the engine management effects the supply to the diaphragm container of low pressure (-→valve "open") or of atmospheric pressure (venting-→valve "closed").

Figure 8:
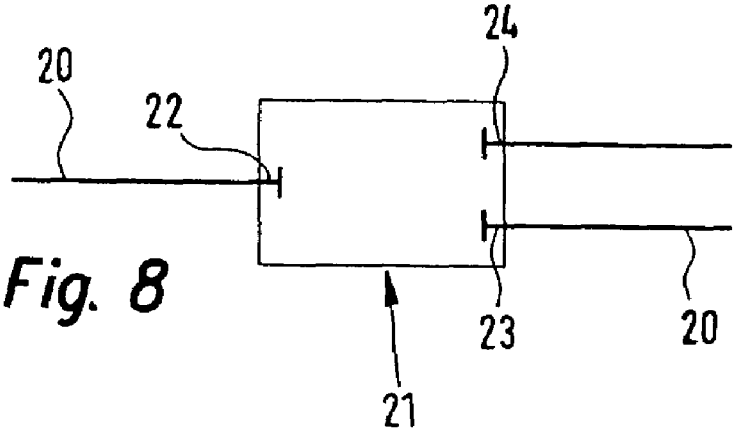
FIG. 8 shows a possible third switching position of a valve basically of the kind of FIGS. 6 and 7.

A reversing valve basically of the said kind is shown in FIG. 8 in a third switching position, in which the valve is not only switched through to the intake pipe, according to FIG. 6, and switched into a venting position, according to FIG. 7, but can also be kept connected both to the intake pipe and to the atmosphere in the third switching position. Such a valve also makes possible the maintenance of a medium vacuum in the low pressure container, which means the same as maintaining a middle position of the closure member 14. Arbitrarily many intermediate positions of a closure member 14 can be set in such a variant embodiment, and the actuator 4 can thus be intermittently or nearly steplessly switched or regulated.

It can also be provided that not only is an electromagnetically operable 3/2-way valve 21 arranged, according to FIGS. 6 and 7, in the control duct 20 from the low pressure container to the intake pipe or to the vacuum pump, but additionally an electromagnetically operable on/off valve is arranged in the control duct 20 between the connection 23 and the low pressure container. Then in a switched-through switching position shown in FIG. 6 of the 3/2-way valve 21, a medium vacuum can also be maintained in the control duct 20 by switching the said on/off valve into the shut-off position, and thereby the closure member 14 of the actuator 4 can be maintained in an intermediate position.

The functional principle according to the invention thus essentially consists in setting up a resistance to the exhaust gas by means of a spring-loaded valve, which is preferably an integral component of a flow branch. This leads to a reduction of the pulsations, thus leading to an improvement of the acoustics (orifice noise and/or vehicle interior noise). Starting from a given rpm/load, the valve is opened, so that the (power-affecting) counter-pressure of the exhaust gas device does not exceed a given value at higher rpms/loads. Flow noises are thus likewise prevented or reduced. The changeover/control of the valve can basically take place in two ways:

The one, last-named, way is the changeover/control by means of an active control element, namely by means of the low pressure container according to the setting of the control electronics or of the engine management.

The other way is the changeover/control by means of a passive control element, while making use of the counter-pressure before the inlet of the pipe branch, namely directly by means of the compression spring only, while omitting the low pressure container. At small throughputs, the valve is kept closed by the compression spring. With increasing throughput, the valve begins to open, and remains stationary when the spring force is as great as the flow force acting on the valve disk. Continuous opening is attained with this design, and in fact completely automatically, and thus without superordinate control.

According to the individual embodiment variant, one or more springs can be provided in a packet. Individual springs can also have a different spring characteristic (linear, progressive). If necessary, for a spring, the spring support in the axial direction of the spring can also be adjusted, in order to arrange a desired spring force or closing force at the actuator.

A passive control element can also be a pressure container, the force of the counter-pressure p being activated indirectly in the pressure container, in order to move the actuator 4 into its opening position. The pressure container is designed such that the pressure side 17 of the diaphragm in the pressure container is connected by a pressure duct (not shown) to the counter-pressure p before the inlet of the pipe branch, while on the low pressure side 18 of the diaphragm, the compression spring is arranged in the pressure container, and the middle of the diaphragm is connected to the actuator, in particular, to the free end of the valve plunger 13 of a disk valve.

We claim:

1. Muffler device of a motor vehicle, comprising:

two mufflers, and an actuator for changing a flow resistance of exhaust gases flowing through the mufflers to change the damping characteristic of the muffler device, wherein the actuator is provided in a pipe bifurcation comprising an inlet and two outlets, each outlet being connected by a connecting pipe to one of the mufflers, and a throughflow cross section of the inlet being variable by means of the actuator, wherein the actuator comprises an active control element and a separate actuating element comprising a low pressure container, a low pressure side of a diaphragm in the low pressure container being connected via a control duct to one of a vacuum pump and an intake pipe of the motor vehicle engine, a middle of the diaphragm being connected to the active control element, and wherein an electromagnetically operable 3/2-way valve is arranged in the control duct and comprises a first connection to one of the intake pipe or the vacuum pump, a second connection to the low pressure side of the low pressure container, and a third connection to the atmosphere, the first connection being connected to the second connection in a first valve position, and the second connection being connected to the third connection in a second valve position.

2. Muffler device of a motor vehicle, comprising:

two mufflers, and an actuator for changing a flow resistance of exhaust gases flowing through the mufflers to change the damping characteristic of the muffler device, wherein the actuator is provided in a pipe bifurcation comprising an inlet and two outlets, each outlet being connected by a connecting pipe to one of the mufflers, and a throughflow cross section of the inlet being variable by means of the actuator, and wherein the actuator comprises a valve plunger that is guided, sealingly and displaceably, through a seating plug in a partition of the pipe bifurcation between the two outlets along an axial axis of the inlet, outward as far as a spring housing containing a spring.

3. Muffler device of a motor vehicle, comprising:

two mufflers, and an actuator for changing a flow resistance of exhaust gases flowing through the mufflers to change the damping characteristic of the muffler device, wherein the actuator is provided in a pipe bifurcation comprising an inlet and two outlets, each outlet being connected by a connecting pipe to one of the mufflers, and a throughflow cross section of the inlet being variable by means of the actuator, and wherein a sealing plug is sealingly received in a hollow-cylindrical housing section of a spring housing or of a pressure container or low pressure container, and is secured to the housing section on a partition of the pipe bifurcation.

* * * * *